US005257511A

United States Patent [19]

Shore et al.

[11] Patent Number: 5,257,511

[45] Date of Patent: Nov. 2, 1993

[54] SPLIT WATER BOX NOZZLE WITH REMOVABLE INSERTS

[75] Inventors: Terence M. Shore, Princeton; Gerald A. Scerra, Worcester, both of Mass.

[73] Assignee: Morgan Construction Company, Worcester, Mass.

[21] Appl. No.: 853,527

[22] Filed: Mar. 18, 1992

[51] Int. Cl.[5] ..... F25D 17/02

[52] U.S. Cl. ..... 62/373; 72/201; 72/238; 148/636; 148/660; 239/390; 266/113; 432/85

[58] Field of Search ..... 72/201, 238, 342.2; 62/63, 373, 374; 239/390, 455; 148/636, 660; 266/113, 111; 432/77, 85

[56] References Cited

U.S. PATENT DOCUMENTS

| | | | |
|---|---|---|---|
| 2,624,178 | 1/1953 | Bedson | 62/374 |
| 3,889,507 | 6/1975 | Kranenberg et al. | 72/201 |
| 4,000,625 | 1/1977 | Beerens et al. | 62/63 |
| 4,439,991 | 7/1984 | Muzak | 62/374 |
| 4,507,949 | 4/1985 | Killilea | 72/201 |
| 4,784,321 | 11/1988 | Delaplace | 239/390 |

FOREIGN PATENT DOCUMENTS

| | | |
|---|---|---|
| 0317785 | 5/1989 | European Pat. Off. . |
| 2453742 | 5/1975 | Fed. Rep. of Germany . |

*Primary Examiner*—Ronald C. Capossela

*Attorney, Agent, or Firm*—Samuels, Gauthier & Stevens

[57] ABSTRACT

A water box is used to cool hot rolled products in a rolling mill. The water box includes a base structure supporting a removable manifold, and a plurality of nozzles removably mounted on and in fluid communication with the manifold. The nozzles are lined with inserts which may be replaced when worn. The manifold is reversible end to end, as are the nozzles, thus enabling the water box to be used on either of two parallel rolling lines.

10 Claims, 4 Drawing Sheets

SPLIT WATER BOX NOZZLE WITH REMOVABLE INSERTS

BACKGROUND OF THE INVENTION

1. Field of the Invention

This invention relates to cooling devices, and is concerned in particular with an improved water box for cooling hot rolled long products such as rods and bars in a rolling mill.

2. Description of the Prior Art

Early water box designs conventionally employed non-split cylindrical nozzles arranged end to end and connected to underlying fixed manifolds or "headers". The non-split configuration of the nozzles greatly complicated the task of removing cobbles from the water boxes. Additional problems included rapid wear, thus necessitating frequent nozzle replacement at considerable cost to the mill operator. Also, extensive inventories of differently sized and configured nozzles were required in order to handle the full range of products being rolled by the mill.

In later water box designs, split nozzles were introduced in order to facilitate cobble removal. However, the mating nozzle segments consisted of complicated and expensive investment castings. These also were prone to rapid wear, and needed to be specially sized to handle the various product sizes being rolled by the mill. Thus, the mill owner continued to be saddled with high replacement and inventory costs.

The principal object of the present invention is to dramatically reduce replacement and inventory costs associated with the operation and maintenance of water boxes in a rolling mill.

SUMMARY OF THE INVENTION

According to one aspect of the invention, the split water box nozzles are provided with replaceable inserts which are specially sized to handle specific product sizes, and which are configured to provide specific coolant applications, all as dictated by the rolling schedule of the mill and the metallurgical properties being sought in the finished product. The inserts constitute the wear components of each nozzle. Thus, only the inserts need be replaced when they become worn, or when a change is required in order to accommodate different rolling schedules and/or process requirements. The outer housing components of the nozzles can remain in place on their respective manifolds, thus eliminating any need for nozzle realignment when insert changes are made.

According to another aspect of the invention, the manifolds are detachably mounted to the water box structures. Thus, subassemblies of manifolds and the nozzles mounted thereon can be set up off line for rapid and efficient installation in the water boxes when changes are required.

Still another aspect of the invention entails designing the manifolds and nozzles for installation in any line of a multiple line mill. This further reduces inventory requirements.

The invention may be understood more readily, and various other aspects and features of the invention may become apparent, from a consideration of the following description.

DESCRIPTION OF PREFERRED EMBODIMENT

Figure 1:
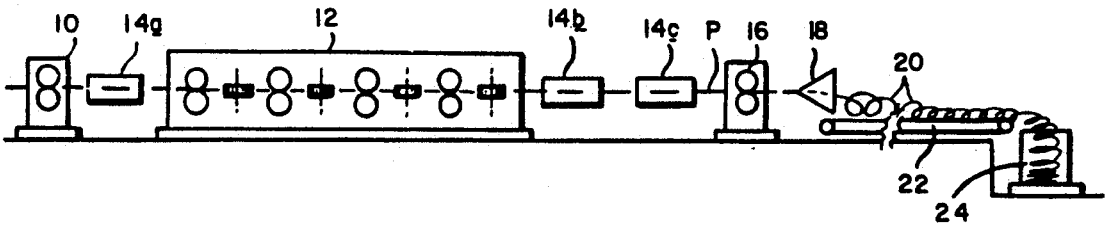
FIG. 1 is a schematic view of the finishing end of a typical rod rolling mill, with water boxes in accordance with the present invention employed to cool the hot rolled product.

Referring initially to Figure the last stand of the intermediate section of a typical rod mill is shown at 10 preceding the finishing block 12. The path along which rods move longitudinally through the mill is depicted at "P". A water box **14*a* is located between stand 10 and the block 12, and additional water boxes 14*b*, 14*c* are located downstream of the block. The last water box 14*c* is followed by a set of driven pinch rolls 16 which insures that the tail end of the product is pushed through a laying head 18. The laying head forms the product into rings 20 which are subjected to controlled cooling on a conveyor 22. A reforming tub 24** receives the rings from the delivery end of the conveyor and gathers them into coils.

Figure 2:
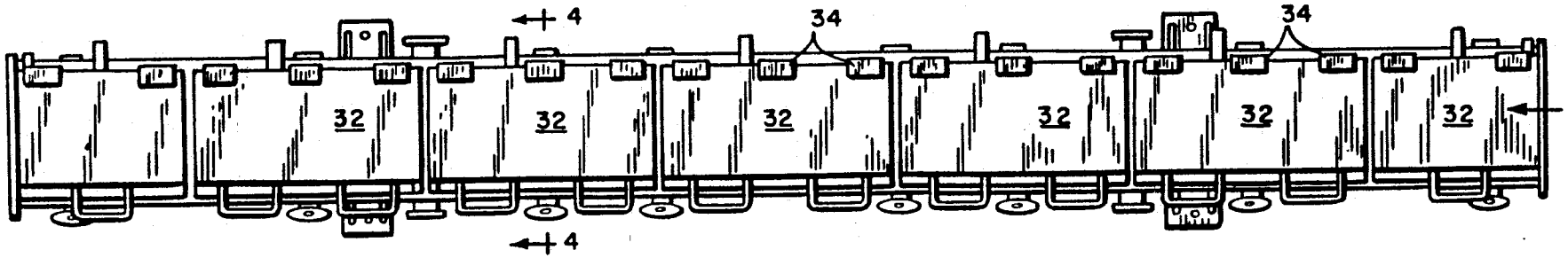
FIG. 2 is a top plan view of a typical water box of the type shown in FIG. 1.
Figure 3:
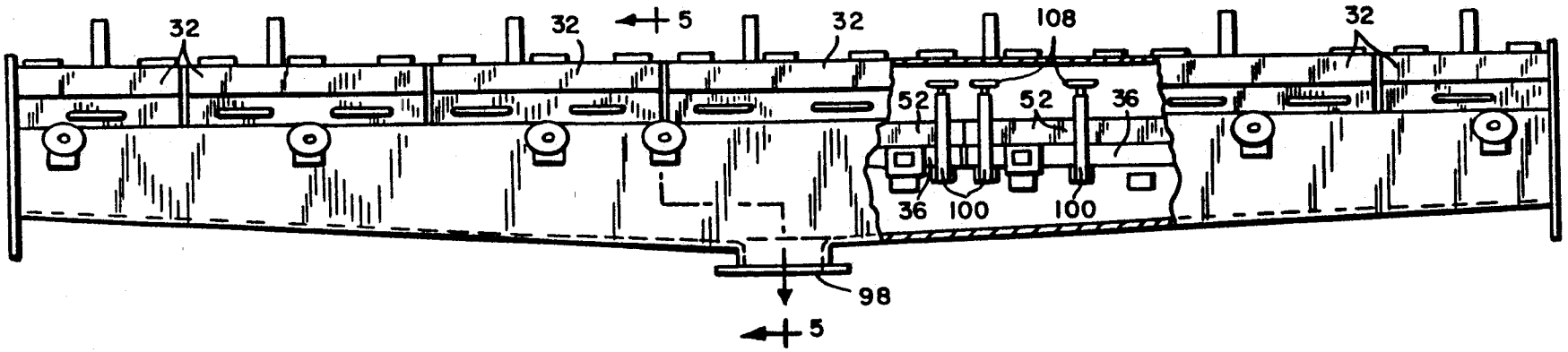
FIG. 3 is a side elevational view of the water box shown in FIG. 2, with portions of the cover and housing side wall broken away in order to show the arrangement of internal components.
Figure 5:
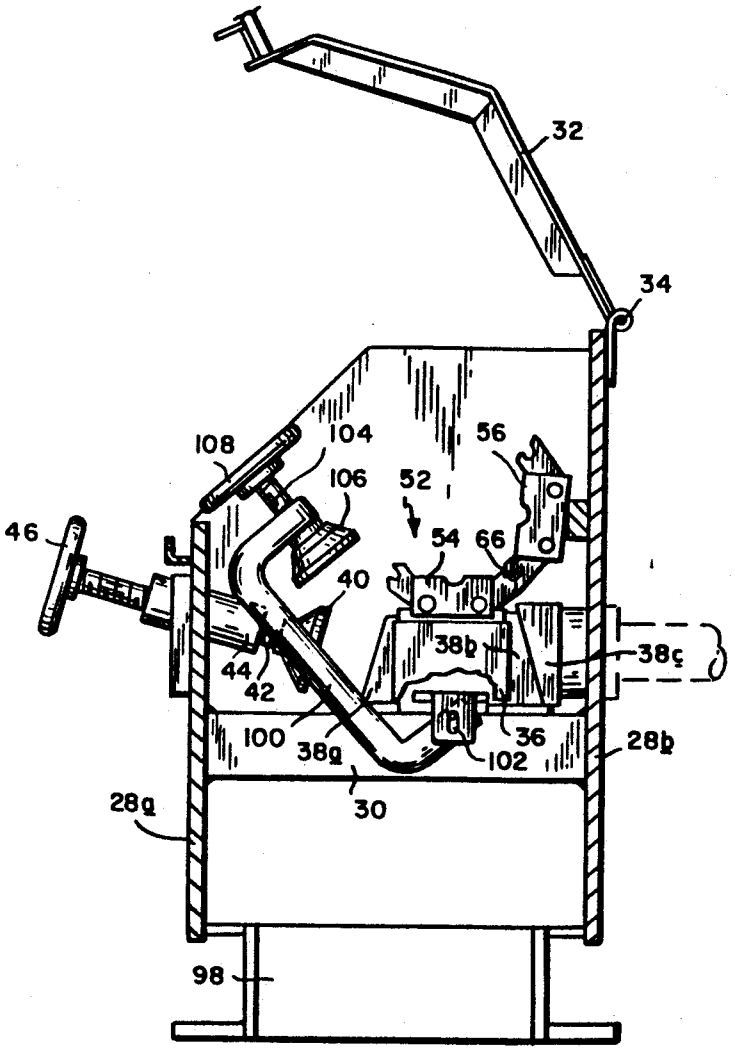
FIG. 5 is a sectional view on an enlarged scale taken along line 5—5 of FIG. 3, and showing the water box cover, the nozzle and manifold clamps and a lid portion of a split nozzle in the open condition.
Figure 4:
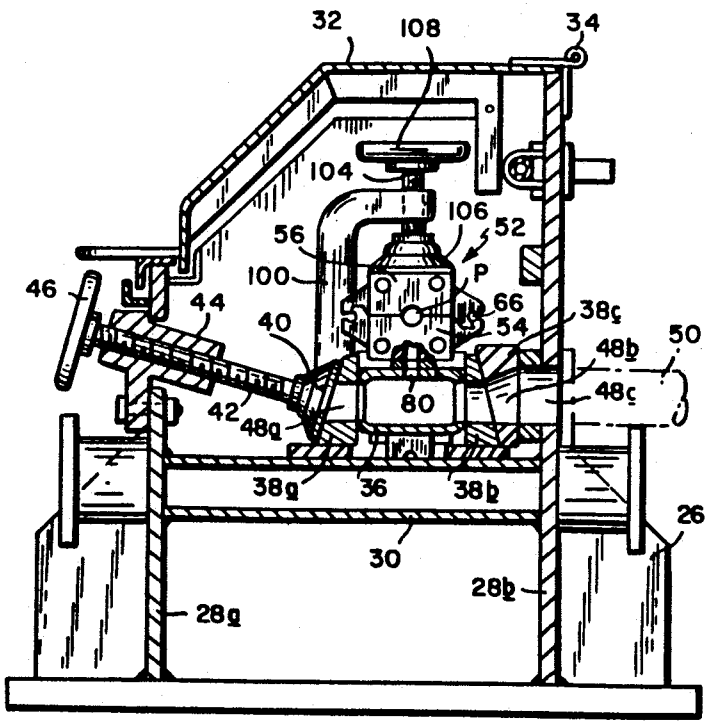
FIG. 4 is a sectional view on an enlarged scale taken on line 4—4 of FIG. 1.
Figure 6:
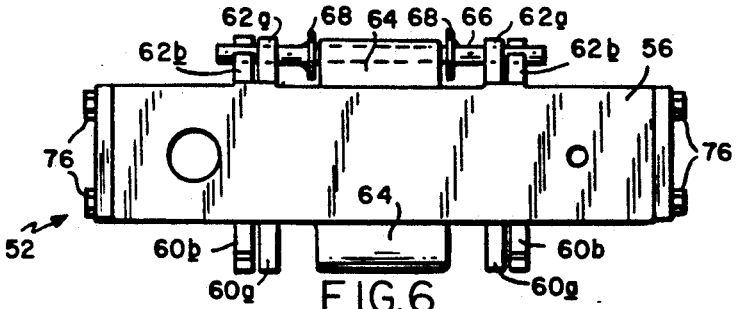
FIG. 6 is a top plan view of a typical nozzle in accordance with the present invention.
Figure 7:
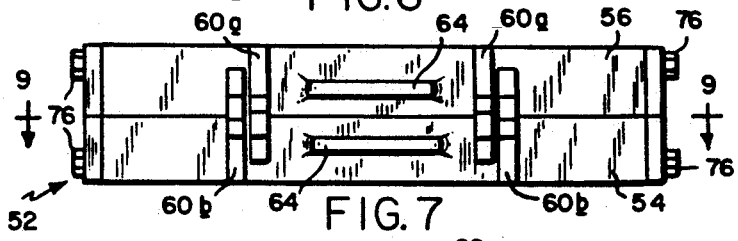
FIG. 7 is a side elevational view of the nozzle shown in FIG. 6.
Figure 9:
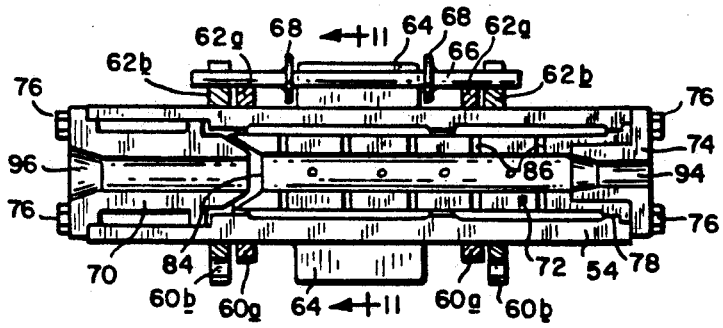
FIG. 9 is a horizontal sectional view taken along line 9—9 of FIG. 7.

With reference now to FIGS. 2 to 5, it will be seen that the typical water box 14 includes a base structure 26 having upstanding side walls **28*a*, 28*b* with cross members 30 extending therebetween. Covers 32 are pivotally connected via hinges 34 to the upper edge of side wall 28*b* for pivotal movement between closed positions as shown in FIGS. 2 to 4, and open positions as shown in FIG. 5. A series of elongate manifolds or "headers" 36 are located end to end within the water box in parallel relationship with the path P of product travel. Each manifold includes external wedge plates 38*a*, 38*b* providing outwardly facing oppositely inclined outer surfaces. Wedge plate 38*b* is adapted to mate in wedged engagement with a wedge plate 38*c* secured to the side wall 28*b*. Wedge plate 38*a* is adapted to be acted upon by a pad 40 carried on the end of a screw 42 threaded through an inclined sleeve 44 extending through side wall 28*a*. The opposite end of the screw 42 carries a handwheel 46. By tightening the handwheel, the manifold wedge plates 38*a*, 38*b* are wedged between the fixed wedge plate 38c and the pad 40**, thereby removably fixing the manifold in place.

Oppositely disposed inlet passageways 48a, 48b extend through the sides of the manifold and the associated wedge plates 38a, 38b. Passageway 48b communicates via a passageway 48c extending through the fixed wedge plate 38c and the housing side wall 28b with a water supply conduit 50. The opposite inlet passageway 48a is blocked by the pad 40 which serves as a closure means.

A plurality of nozzles generally indicated at 52 are supported on and arranged sequentially along the length of each manifold 36. With additional reference to FIGS. 6–10, it will be seen that each nozzle includes an outer housing having a base portion 54 and a lid portion 56. The base and lid portions are provided on opposite sides respectively with coacting pairs of laterally protruding notched ears 60a, 60b and 62a, 62b, and with handles 64.

A hinge pin 66 is adapted to be assembled with one or the other of the coating pairs of notched ears. If the pin is assembled with the ears 62a, 62b, the lid portion will pivot upwardly from the right, as shown in FIG. 5. Conversely, if the hinge pin is assembled with the ears 60a, 60b, then the lid will pivot upwardly from the left. The hinge pin 6 is provided with mutually spaced discs 68 which coact the laterally protruding handles 64 to prevent the pin from being axially dislodged.

The base and lid portions 54, 56 of each nozzle are lined with inserts which comprise the wear components of the nozzles, and which control the manner in which coolant is applied to the product passing therethrough. More particularly, and with reference to FIGS. 9 and 11, it will be seen that the base and lid portions each contain mating insert members 70, 72 and 74. The insert members 70 are secured to their respective housing portions 54, 56 by external screws 76. The same is true of the insert members 74 at the opposite end of the nozzle. The intermediate insert members 72 are held against internal shoulders 78 by the insert members 74.

Figure 11:
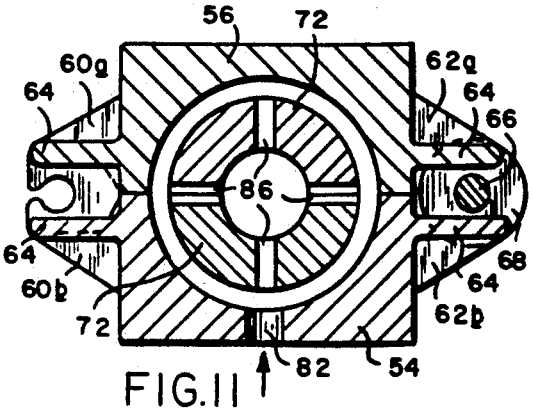
FIG. 11 is a sectional view taken along line 11—11 of FIG. 9.

In the insert arrangement shown in FIG. 11, water is admitted to the nozzle from an opening 80 (see FIG. 4) in the underlying manifold 36 via bottom nozzle inlet 82. From here, the water flows between the spaces provided between inside walls of the housing portions 54, 56 and the inserts 70, 72 and 74. The gap 84 between inserts 70 and 72 defines an annular orifice designed to apply coolant to the product at an angle. Other radial orifices indicated typically at 86 in the inserts 72 apply additional water to the product.

Figure 10:
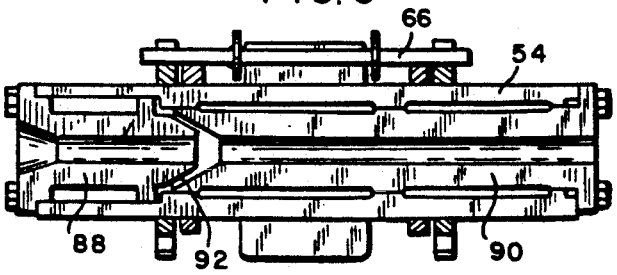
FIG. 10 is a view similar to FIG. 9 showing a different configuration of inserts.
Figure 8:
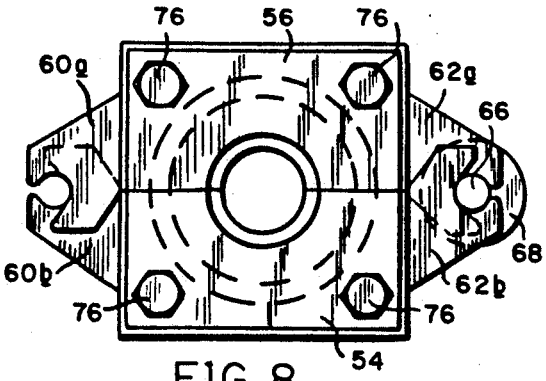
FIG. 8 is an end view of the nozzle.

The same outer nozzle components 54, 56 may be employed with other inserts to produce different cooling modes. For example, as shown in FIG. 10, only two inserts 88, 90 may be used to define a single annular orifice 92. Any number of other arrangements may be developed, all utilizing the same outer nozzle components.

After being applied to the products passing through the nozzles, the cooling water exits via the open entry and exit nozzle ends 94, 96 for collection at the base of the water box housing where it is drained to a flume (not shown) via drain opening 98.

During operation of the mill, the lid portions 56 of the nozzles are held in their closed positions, and the nozzles themselves are held onto their respective manifolds 36, by a series of C-shaped clamps 100. The clamps 100 are pivotally connected at their lower ends as at 102 to depending brackets on the undersides of the manifolds. The upper ends of the clamps rotatably support screws 104 provided at their lower ends with clamping pads 106 and at their upper ends with handwheels 108.

When the clamps 100 are in place with their handwheels 108 tightened as shown in FIG. 4, the pads 106 press down on the nozzles to hold them in place on the manifolds and to also maintain the lid portions 56 closed.

Figure 12:
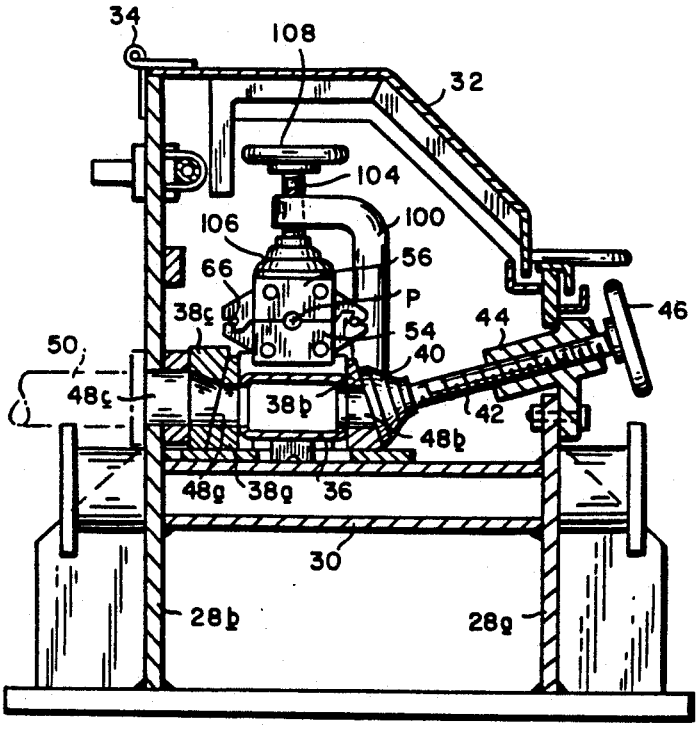
FIG. 12 is a view similar to FIG. 4 showing the same nozzle and manifold components mounted in the opposite hand water box housing of a parallel rolling line.

In light of the foregoing, it will now be appreciated by those skilled in the art that the present invention embodies a number of novel features which provide significant advantages over prior art conventional arrangements. For example, and as shown in FIG. 12, the sam=basic components can be employed in an opposite hand arrangement, as would be the case in a mill having dual parallel rolling lines. Here, the manifolds 36 would simply be shifted laterally to the other rolling line. The orientation of the clamps 100 would be reversed, making them accessible from the opposite side. Also, the hinge pins 66 would be shifted to the opposite side. Thus, a mill owner can use the same basic components to service multiple processing lines, thereby reducing inventories of spare and replacement parts.

The use of nozzle inserts is also advantageous, first because the inserts serve as relatively inexpensive wear parts, and secondly because a wide array of inserts can be employed within the same outer nozzle components to achieve different coolant applications.

The ability to quickly disengage and remove the manifolds and the nozzles mounted thereon is also advantageous in that it allows spare manifold/nozzle assemblies to be set up off line for quick introduction into the water boxes.

We claim:

1. Apparatus for applying liquid coolant to elongate elements moving longitudinally along a path, said apparatus comprising:

a base structure:

an elongated tubular manifold removably supported on said base structure in parallel relationship with said path, said manifold having first and second laterally aligned inlet ports extending respectively through opposite sides thereof;

closure means for releasably securing said manifold on said base structure;

a plurality of nozzles arranged sequentially along and in fluid communication with said manifold, said nozzles having through passageways aligned with said path and lined with removable inserts, and having lid portions which may be manipulated between open and closed positions in order to provide access to said inserts; and coolant supply means for supplying liquid coolant via said manifold to said nozzles for application to the elongate elements moving longitudinally through said passageways, said manifold being reversible end to end on said base structure to place either of said inlet ports in communication with said coolant supply means, with the other of said inlet ports being blocked by said closure means.

2. The apparatus as claimed in claim 1 further comprising clamp means for releasably retaining said lid portions in said closed positions.

3. The apparatus as claimed in claim 2 wherein said clamp means are pivotally mounted on said manifold.

4. The apparatus as claimed in claim 2 wherein said nozzles are removably secured to said manifold by said clamp means.

5. The apparatus as claimed in claim 4 further comprising second clamp means associated with said base structure for releasably retaining said manifold thereon.

6. The apparatus as claimed in claim 1 wherein said inlet passageways extend through side plates on said manifold, said side plates having oppositely inclined outer faces adapted to coact in sealing engagement with complimentary inclined surfaces on said inlet fitting and said closure means.

7. The apparatus as claimed in claim 1 wherein said lid portions are pivotally mounted for movement between said open and closed positions.

8. The apparatus as claimed in claim 7 wherein said nozzles are provided along opposite sides with alternatively usable means for pivotally mounting said lid portions.

9. Apparatus for applying liquid coolant to elongate elements moving longitudinally along a path, said apparatus comprising:

a base structure;

an elongated tubular manifold removably supported on said base structure in parallel relationship with said path, said manifold having first and second laterally aligned inlet ports extending respectively through opposite sides thereof;

closure means for releasably securing said manifold on said base structure;

a plurality of nozzles arranged sequentially along and in fluid communication with said manifold, said nozzles having through passageways aligned with said path; and coolant supply means for supplying liquid coolant via said manifold to said nozzles for application to the elongate elements moving longitudinally through said passageways, said manifold being reversible end to end on said base structure to place either of said inlet ports in communication with said coolant supply means, with the other of said inlet ports being blocked by said closure means.

10. The apparatus as claimed in claim 9 wherein said inlet passageways extend through side plates on said manifold, said side plates having oppositely inclined outer faces adapted to coact in sealing engagement with complimentary inclined surfaces on said inlet fitting and said closure means.

* * * * *